US010401120B2

(12) United States Patent
Iwasawa

(10) Patent No.: US 10,401,120 B2
(45) Date of Patent: Sep. 3, 2019

(54) CUT-OFF DEVICE FOR ELECTRIC MECHANISM IN SIMULATION GUN

(71) Applicant: TOKYO MARUI CO, LTD., Tokyo (JP)

(72) Inventor: Iwao Iwasawa, Tokyo (JP)

(73) Assignee: TOKYO MARUI CO., LTD., Tokyo (JP)

( * ) Notice: Subject to any disclaimer, the term of this patent is extended or adjusted under 35 U.S.C. 154(b) by 0 days.

(21) Appl. No.: 15/560,548

(22) PCT Filed: Mar. 24, 2015

(86) PCT No.: PCT/JP2015/058935
§ 371 (c)(1),
(2) Date: Sep. 22, 2017

(87) PCT Pub. No.: WO2016/151764
PCT Pub. Date: Sep. 29, 2016

(65) Prior Publication Data

US 2018/0120050 A1 May 3, 2018

(51) Int. Cl.
*F41B 11/71* (2013.01)
*F41B 11/646* (2013.01)

(52) U.S. Cl.
CPC ..... *F41B 11/71* (2013.01); *F41B 11/646* (2013.01)

(58) Field of Classification Search
CPC ..... F41B 11/71; F41B 11/646; F41B 11/003; F41B 11/08; F41B 11/00; F41B 11/64;
(Continued)

(56) References Cited

U.S. PATENT DOCUMENTS 4,891,898 A * 1/1990 Houseman ..... F41A 19/15 42/69.02
5,261,384 A * 11/1993 Hu ..... F41B 11/57 124/16

(Continued)

FOREIGN PATENT DOCUMENTS

JP 55-150498 11/1980
JP 3-221793 9/1991

(Continued)

OTHER PUBLICATIONS

International Search Report dated Jun. 16, 2015.

*Primary Examiner* — Derrick R Morgan
(74) *Attorney, Agent, or Firm* — Jacobson Holman, PLLC

(57) ABSTRACT

A switching mechanism that controls a drive circuit of an electric motor in order to select any one of a single shooting mode, and a successive shooting mode. The switching mechanism includes a selector unit which is provided in order to select between the single shooting mode and the successive shooting mode, a switch which closes the drive circuit in response to an operation of a trigger, and a cut-off member which turns off the switch when the single shooting mode is selected. An engagement location for the movable portion and the cut-off member in the piston cylinder mechanism is set in a front portion in a direction of the reciprocating operation of the movable portion, and a range of selecting a time taken until the front portion engages with the cut-off member after the movable portion starts to retract can be lengthened.

3 Claims, 13 Drawing Sheets

(58) Field of Classification Search
CPC ..... F41B 11/60; F41B 11/641; F41B 11/642; F41B 11/68; F41A 19/33
See application file for complete search history.

(56) References Cited

U.S. PATENT DOCUMENTS 6,564,788 B1* 5/2003 Hu ..... F41B 7/003 124/31
6,634,129 B1* 10/2003 Freeman, Jr. ..... F41A 3/26 42/69.02
7,100,592 B1* 9/2006 Yang ..... F41B 7/00 124/67
2003/0056778 A1* 3/2003 Schavone ..... F41B 11/51 124/74
2005/0183709 A1* 8/2005 Marsac ..... F41B 11/57 124/63
2006/0137671 A1* 6/2006 Chu ..... F41B 7/08 124/32
2006/0231083 A1* 10/2006 Tsurumoto ..... F41A 19/66 124/66
2006/0243263 A1* 11/2006 Tsurumoto ..... F41A 19/66 124/66
2008/0229642 A1* 9/2008 Hu ..... F41B 11/64 42/54
2010/0022160 A1* 1/2010 Lee ..... F41B 11/646 446/473
2010/0065032 A1* 3/2010 Yang ..... F41B 11/57 124/27
2010/0065033 A1* 3/2010 Yang ..... F41B 11/642 124/66
2011/0192386 A1* 8/2011 Hu ..... F41B 11/57 124/32
2011/0192387 A1* 8/2011 Hu ..... F41B 11/57 124/80
2011/0283984 A1* 11/2011 Hu ..... F41B 11/57 124/77
2014/0338648 A1* 11/2014 Hu ..... F41B 11/71 124/32
2015/0007804 A1* 1/2015 Tippmann, Jr. ..... F41B 11/722 124/73
2015/0059722 A1* 3/2015 Yang ..... F41B 11/646 124/27
2015/0059724 A1* 3/2015 Yang ..... F41B 11/646 124/66
2015/0176942 A1* 6/2015 Hu ..... F41B 11/71 124/32
2015/0226513 A1* 8/2015 Lin ..... F41B 7/08 124/17
2015/0377582 A1* 12/2015 Kang ..... F41B 11/64 124/71
2016/0084611 A1* 3/2016 Wong ..... F41B 11/89 124/31
2016/0102936 A1* 4/2016 Seabrook ..... F41A 33/04 434/21
2016/0116248 A1* 4/2016 Cheng ..... F41B 11/57 124/16
2017/0176133 A1* 6/2017 Sullivan ..... F41A 9/71
2017/0299323 A1* 10/2017 Nachefski ..... F41A 17/56
2018/0045483 A1* 2/2018 Iwasawa ..... F41B 11/643
2018/0051958 A1* 2/2018 Iwasawa ..... F41B 11/70

FOREIGN PATENT DOCUMENTS

JP 2006-300462 11/2006
JP 2010-25501 2/2010

* cited by examiner

CUT-OFF DEVICE FOR ELECTRIC MECHANISM IN SIMULATION GUN

TECHNICAL FIELD

The present invention relates to a cut-off device for an electric mechanism in a simulation gun having a configuration which includes a piston cylinder mechanism, in which the electric mechanism drives a movable portion of the piston cylinder mechanism in one direction such that pressure is accumulated in pressurization means, and in which the pressurization means is released such that the piston cylinder mechanism is driven in a direction opposite to the one direction and compressed air for shooting a bullet is generated.

BACKGROUND ART

Simulation guns include so-called electric guns and are based on the invention relating to an automatic air gun disclosed in JP-A-3-221793 (JP-B-7-43238) claimed by the applicant of this application. Since there is no apprehension of running out of gas as in the case of a gas gun, the electric guns are in wide use. Some electric guns include a shooting mode selection mechanism that can select between a single shooting mode being called a semi-automatic mode in which one shooting is performed every time a trigger is pulled, and a successive shooting mode being called a full-automatic mode in which shooting is successively performed while the trigger is pulled.

Since the shooting mode selection mechanism is controlled by turning on and off a drive circuit of an electric motor, a trigger operation and the electric motor are required to be interconnected to each other in any form. Generally, the trigger is not so far from the electric motor which drives a piston cylinder mechanism. Therefore, in electric guns in the related art, in regard to the interconnection between the trigger and the electric motor, ON-OFF control of a switch has been performed by using a sector gear driven by the electric motor. The sector gear meshes with a rack provided on a piston side and causes the piston to retract. Since one shooting is performed for each rotation of the sector gear, it is convenient for performing ON-OFF control of the switch.

The sector gear is at a position close to the electric motor that is a drive source. In order to cause the sector gear and the switch to be interconnected to each other, the sector gear and the switch are required to be disposed close to each other. Requiring the sector gear and the switch to be disclosed close to each other becomes restriction, resulting in a problem of deterioration in the degree of freedom of the layout for the piston cylinder mechanism, the electric mechanism, and the like in the simulation gun. In addition to the influence on the layout, the restriction denotes that it is difficult to motorize simulation guns of a type in which the sector gear is at a position relatively far from the trigger. Therefore, in a case of modeling a long barreled-type electric gun by using a method in the related art, for example, there is no alternative but to shorten the length of the piston cylinder mechanism, resulting in an obstacle to developing a product.

Moreover, in the invention of JP-A-2006-300462, reliability of switching is achieved after energization to a motor is cut off, the sector gear is unmeshed from the rack due to inertial rotation and is caused to engage with the trigger through an operation in which a movable member of the piston cylinder mechanism returns. This method basically has the same intent as the invention of JP-A-3-221793. In this manner, it has been technically common for the sector gear and the switch to be disposed in a very restrictive manner. As a result, in spite of an electric gun modeled on a long barreled-type gun which is longitudinally lengthened, there is no alternative but to shorten the piston cylinder mechanism, resulting in a problem in that the sector gear and the switch cannot be disposed away from each other as long as the method in the related art is used.

CITATION LIST

Patent Literature

[PTL 1] JP-A-3-221793
[PTL 2] JP-A-2006-300462

SUMMARY OF INVENTION

Technical Problem

The present invention has been made in consideration of the foregoing points, and an object thereof is to be able to perform cut-off control with respect to a switch without depending on a sector gear and to resolve restriction on a layout for a piston cylinder mechanism, an electric mechanism, and the like in a simulation gun. In addition, another object of the present invention is to provide a cut-off device for an electric mechanism in a simulation gun, which can be realized without difficulty and change in length, even in a case of an electric gun modeled on a long barreled-type gun, for example.

Solution to Problem

In order to attain the above-described objects, according to the present invention, there is provided a cut-off device for an electric mechanism in a simulation gun having a configuration which includes a piston cylinder mechanism, in which the electric mechanism drives a movable portion of the piston cylinder mechanism in one direction such that pressure is accumulated in pressurization means, and in which the pressurization means is released such that the piston cylinder mechanism is driven in a direction opposite to the one direction and compressed air for shooting a bullet is generated. In the configuration, the cut-off device includes a switching mechanism that controls a drive circuit of an electric motor in order to select any one of a single shooting mode in which one bullet shooting is performed through one reciprocating operation in the piston cylinder mechanism, and a successive shooting mode in which a plurality of the bullet shootings are performed through a plurality of the successive reciprocating operations in the piston cylinder mechanism. The switching mechanism includes at least a selector unit which is provided in order to select between the single shooting mode and the successive shooting mode, a switch which closes the drive circuit in response to an operation of a trigger, and a cut-off member which engages with the movable portion being driven in the one direction and turns off the switch when the single shooting mode is selected. An engagement location for the movable portion and the cut-off member in the piston cylinder mechanism is set in the front in a direction of the reciprocating operation of the movable portion, so that a range of selecting a time taken until the front portion engages with the cut-off member after the movable portion starts to retract is able to be widened.

The simulation gun of the present invention has a configuration which includes the piston cylinder mechanism, in which the electric mechanism drives the movable portion of the piston cylinder mechanism in the one direction such that pressure is accumulated in the pressurization means, and in which the pressurization means is released such that the piston cylinder mechanism is driven in the direction opposite to the one direction and compressed air for shooting a bullet is generated. The piston cylinder mechanism is a combination of a cylinder and a piston. In many cases, the piston is configured to serve as the movable portion and to perform the reciprocating operation with respect to the cylinder, thereby generating compressed air. However, an inverted configuration can be employed. A side moving for the compression becomes the movable portion in the present invention.

Generally, in many cases, pressurization means in which pressure is accumulated by the movable portion is an elastic member, particularly a spring represented by a coil spring. In the spring of such a type, force of the accumulated pressure is released at once, so that the movable portion can be instantly operated and compressed air can be easily obtained. The length of the movable portion for a reciprocating movement is short in a case of a so-called short barreled-type gun, and it is desirable to be long in a long barreled-type gun. However, according to the present invention, the longitudinal length does not restrict the configuration, leading to an effect of contributing to the replication of a precise model.

The cut-off device of the present invention includes the switching mechanism that controls the drive circuit of the electric motor in order to select any one of the single shooting mode in which the one bullet shooting is performed through the one reciprocating operation in the piston cylinder mechanism, and the successive shooting mode in which the plurality of bullet shootings are performed through the plurality of successive reciprocating operations in the piston cylinder mechanism. Even though the configuration itself is not new, being provided with a switching mechanism is one of the factors required in the present invention.

The switching mechanism includes at least the selector unit which is provided in order to select between the single shooting mode and the successive shooting mode, the switch which closes the drive circuit in response to an operation of the trigger, and the cut-off member which engages with the movable portion being driven in the one direction and turns off the switch when the single shooting mode is selected. In the present invention, the cut-off member operates by being engaged with the movable portion and does not depend on a sector gear. The single shooting mode is used in the sense of a shooting mode for once and is not used in the sense of shooting one shot. Therefore, in a case of a simulation gun having a plurality of barrels, a plurality of bullets are shot through one shooting operation.

In the configuration, the engagement location for the movable portion and the cut-off member in the piston cylinder mechanism is set in the front portion in the direction of the reciprocating operation of the movable portion, so that the range of selecting a time taken until the front portion engages with the cut-off member after the movable portion starts to retract is able to be lengthened. In regard to engagement in the front portion of the movable portion in the direction of the reciprocating operation, the time taken until the engagement can be set to be longer than that of engagement in a rear portion. In a case where the time taken until the engagement is short, cutting-off is performed by using inertial force. However, since the time taken until the engagement is sufficiently long, cutting-off is performed by using power, and thus, the reliability is further enhanced.

The configuration in which the simulation gun is a long barreled-type gun, the piston cylinder mechanism and the electric mechanism are disposed away from each other, and the piston cylinder mechanism is formed so as to be longer than general piston cylinder mechanisms is a preferable embodiment. As the piston cylinder mechanism has a sufficient stroke, strong compressed air can be generated, on condition that there is little restriction on the length of the piston cylinder mechanism. On the other hand, when the piston cylinder mechanism has a sufficient operation stroke, the engagement location for the movable portion and the cut-off member in the piston cylinder mechanism also tends to have a positional relationship of being away from the trigger. Even in such a case, according to the present invention, it is possible to configure the cut-off device for an electric mechanism without difficulty.

BRIEF DESCRIPTION OF THE DRAWINGS

FIG. 4 consists of FIGS. 4A and 4B and illustrates the cylinder assembly used in the simulation gun according to the invention.

FIG. 7 consists of FIGS. 7A and 7B and illustrates a switching mechanism according to the invention.

FIG. 8 consists of FIGS. 8A and 8B and illustrates the switching mechanism according to the invention.

FIG. 9 consists of FIGS. 9A, 9B and 9C and illustrates an example of a switch.

FIG. 10 consists of FIGS. 10A and 10B and illustrates an operation of the cut-off device for an electric mechanism in the simulation gun according to the invention.

FIG. 11 consists of FIGS. 11A and 11B and illustrates an operation of the cut-off device for an electric mechanism in a simulation gun according to the invention.

FIG. 12 consists of FIGS. 12A and 12B and illustrates an operation of the cut-off device for an electric mechanism in a simulation gun according to the invention.

REFERENCE NUMBERS

10 COMPRESSED AIR GENERATING UNIT
11, 12, 13 BARREL
14 CARTRIDGE PORTION
15 SIGHT MECHANISM
16 CONNECTION GASKET
17 TRIGGER
18 SWITCH PORTION
19 OUTER BARREL
20 CYLINDER ASSEMBLY
21, 22, 23 CYLINDER
24 BLAST NOZZLE
25 PIPE MEMBER
26 FRONT FIXING MEMBER
27 REAR FIXING MEMBER
28 INTER-NOZZLE
29 NOZZLE BASE
30 PISTON ASSEMBLY
31, 32, 33 PISTON
34 JOINT PORTION
35 PISTON SHAFT
36 RACK
37 ROD
38 SEAL MEMBER
39 GEAR DISPOSITION SPACE
40 ELECTRIC MECHANISM
41 OUTPUT GEAR
42 ELASTIC MEMBER
43 ELECTRIC MOTOR
44 PINION
45 REDUCTION GEAR SET
46 PISTON MOVEMENT PORTION
47 GUIDE GROOVE
48 SELECTOR
49 LATCH MEMBER
50 CARTRIDGE ASSEMBLY
51 MAGAZINE
52 SELECTOR OPERATING UNIT
53 SWITCHING MEMBER
54 CUT-OFF MEMBER
55 SWITCHING MECHANISM
56 SELECTOR CLICK
57 SELECTOR MEMBER
58 END PORTION ON ONE SIDE
59 END PORTION ON THE OTHER SIDE
60 TRIGGER INTERLOCKING PORTION
61 DISPLAY

ADVANTAGEOUS EFFECTS OF INVENTION

Since the present invention is configured and operates as described above, it is possible to control cutting off the switch of the electric mechanism without depending on a sector gear and to resolve restriction on a layout for a piston cylinder mechanism, an electric mechanism, and the like in a simulation gun. Since the time taken until engagement can be set to be sufficiently long, cutting-off is performed by using power, thereby exhibiting the effect that the reliability is further enhanced. In addition, according to the present invention, it is possible to provide a cut-off device for an electric mechanism in a simulation gun, which can be realized without difficulty and change in length, even in a case of an electric gun modeled on a long barreled-type gun, for example.

DETAILED DESCRIPTION OF THE INVENTION

Figure 1:
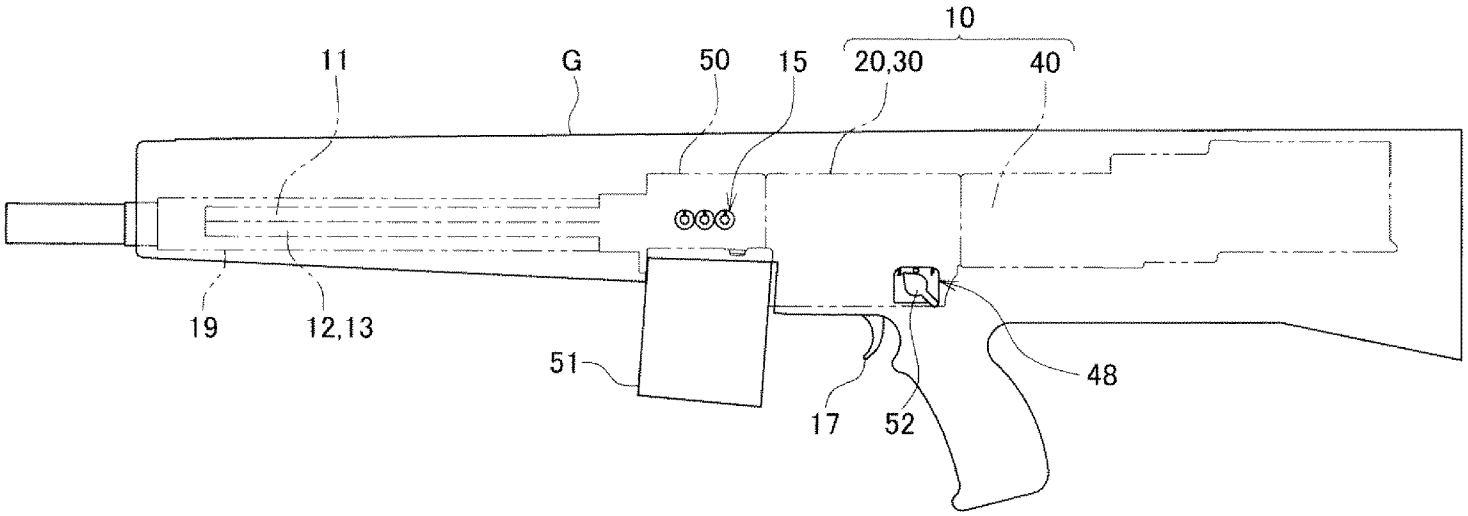
FIG. 1 is a side view illustrating an example of a simulation gun in which a cut-off device for an electric mechanism according to the present invention is applied.

Hereinafter, with reference to the illustrated embodiment, the present invention will be described in more detail. FIG. 1 is a general view of a long barreled-type simulation gun in which a cut-off device for an electric mechanism of the present invention is applied. The simulation gun indicates a multi-bullet shooting electric gun G. The electric gun G has three barrels 11, 12, 13. Therefore, a compressed air generating unit 10 is configured to have a cylinder assembly 20 constituted by three cylinders 21, 22, 23, a piston assembly 30 constituted by three pistons 31, 32, 33, and an electric mechanism 40 driving the piston assembly 30.

Figure 2:
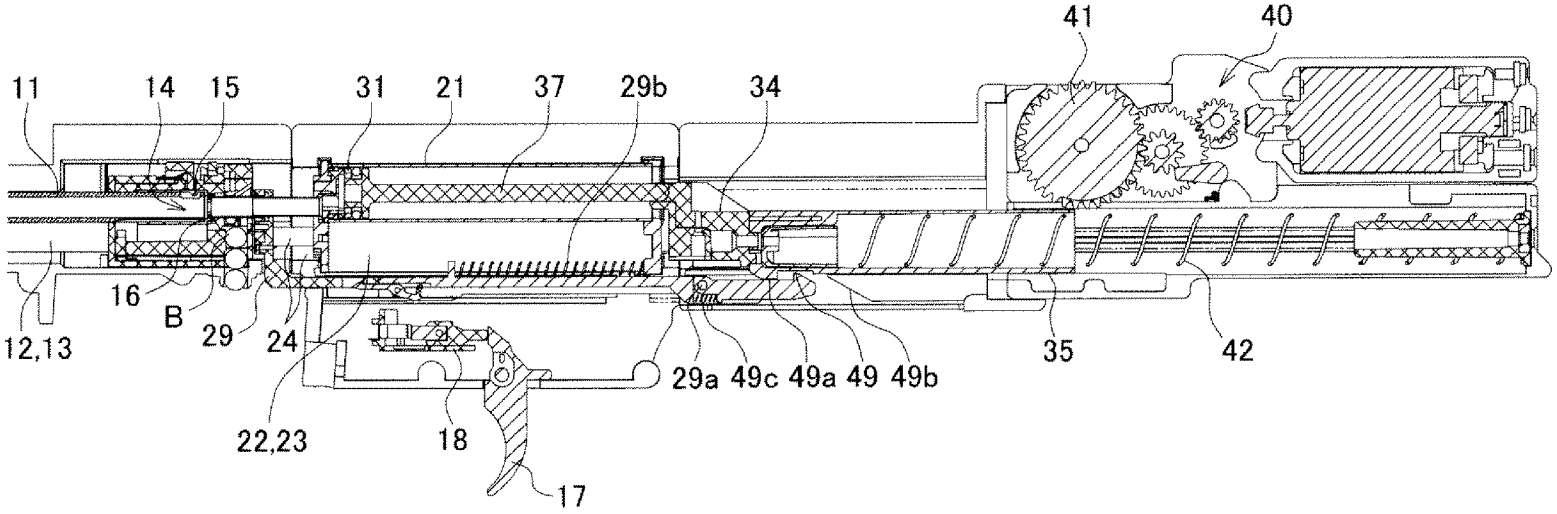
FIG. 2 is a sectional view illustrating an enlarged main portion of the simulation gun in which the cut-off device for an electric mechanism according to the invention is applied.

A cartridge assembly 50 is provided in a rear portion of the barrels, and a detachable magazine 51 is mounted at a lower portion thereof. A cartridge portion 14 is set in the cartridge assembly 50, so that a bullet B is disposed inside the rear end of each of the three barrels 11, 12, 13. The cartridge portion 14 is provided with a sight mechanism 15 for adjusting a trajectory. In addition, a connection gasket 16 covers the outside of the rear ends of the three barrels 11, 12, 13. The connection gasket 16 is formed of a soft material such as rubber, having seal performance (FIG. 2).

The compressed air generating unit 10 is a part generating air with which the bullet B is blasted in order to shoot each bullet B from each of the barrels 11, 12, 13 in the multi-bullet shooting electric gun G. The barrels themselves are combined such that three thereof form a triangle shape when seen from the front. The compressed air generating unit 10 is disposed at the rear inside the electric gun G. The cylinder assembly 20, the piston assembly 30, and the electric mechanism 40 configuring the compressed air generating unit 10 are disposed in an approximately straight line in order thereof.

Figure 3:
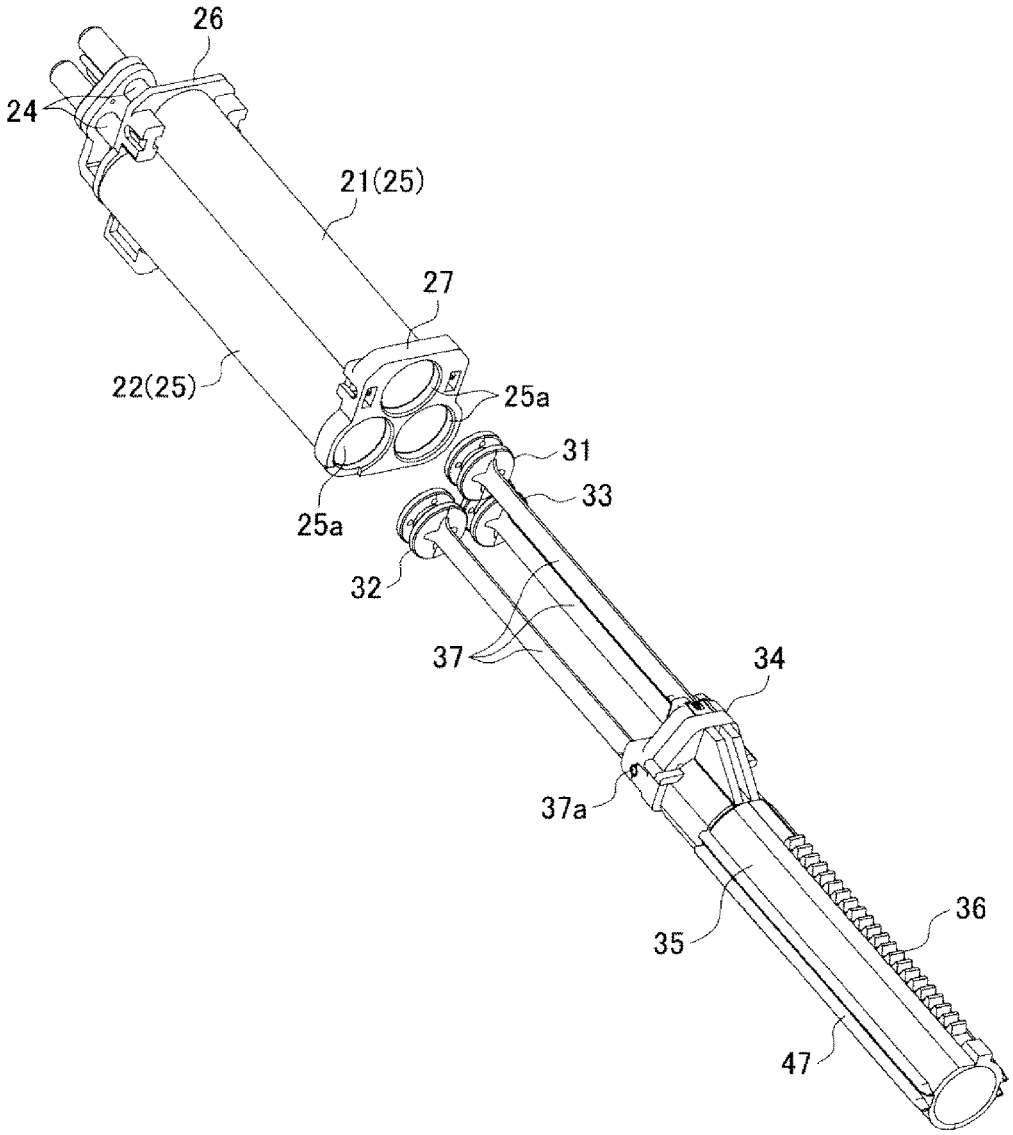
FIG. 3 is an exploded perspective view illustrating a cylinder assembly and a piston assembly used in the simulation gun according to the invention.

The cylinder assembly 20 is positioned in a rear portion of the three barrels 11, 12, 13, has an air-blast nozzle 24 at a tip end, and has the three cylinders 21, 22, 23 in which the pistons 31, 32, 33 respectively reciprocate. The illustrated cylinder assembly 20 is configured to have three pipe members 25, a front fixing member 26 fixing each of the pipe members 25 to a tip end portion, and a rear fixing member 27 fixing each of the pipe members 25 to a rear end portion (refer to FIGS. 3 and 4).

Figure 4A:
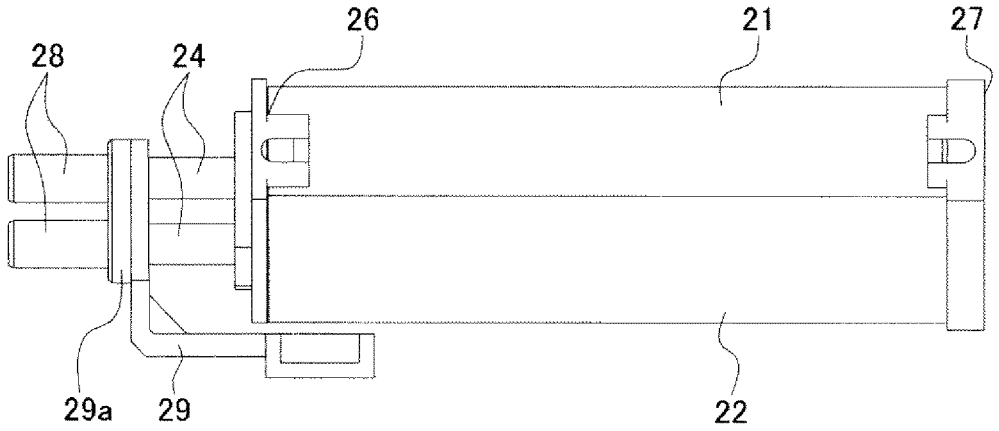
FIG. 4A illustrates a side view.
Figure 4B:
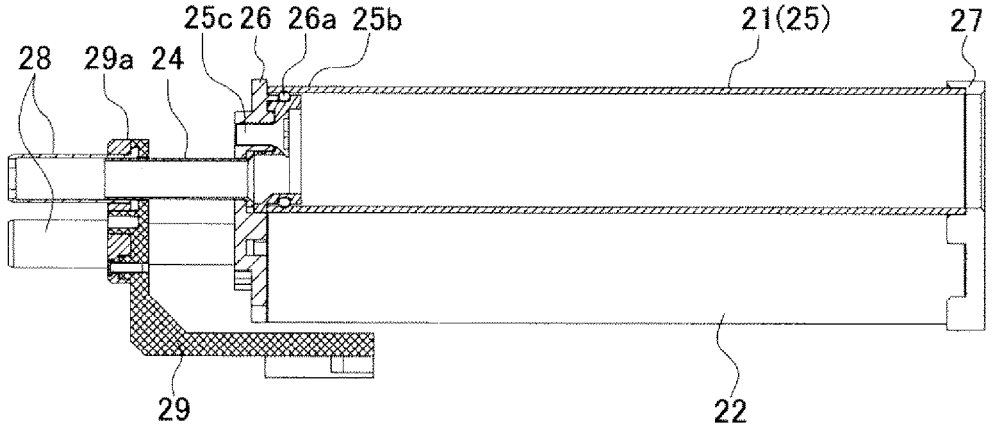
FIG. 4B illustrates a longitudinal sectional view taken along a central line.

The air-blast nozzle 24 is provided in the front fixing member 26, and an insertion port 25*a* for the piston is open in the rear fixing member 27. A blast nozzle 24 is provided in front of a pipe attachment member 25*b*, and the pipe attachment member 25*b* is attached to the rear surface of the front fixing member 26 by a fastener 25*c*. The pipe attachment member 25*b* has a positional relationship with the pipe member 25 in which the pipe attachment member 25*b* is fitted, and is assembled in an air-tight manner by using seal means 26*a* (FIG. 4).

As seen in the illustrated embodiment, an inter-nozzle 28 is connected to the cartridge portion 14 and the air-blast nozzle 24 and is provided to be movable in the forward-rearward direction by a nozzle base 29. The inter-nozzle 28 slides with respect to the blast nozzle 24 in an air-tight manner and is at a position where a bullet is blasted with compressed air generated in the compressed air generating unit 10. The inter-nozzle 28 is attached to an erected portion 29*a* of the nozzle base 29 and is incorporated in a main body of the simulation gun G so as to be able to advance and retract.

Therefore, the inter-nozzle 28 retracts by being engaged with a latch member 49 described below, in response to retract operations of the pistons 31, 32, 33 and is caused to advance by a spring of biasing means 29*b* acting on the nozzle base 29 (refer to FIG. 2). Then, the tip end thereof is configured to also slide with respect to the connection gasket 16 in an air-tight manner, to be separated from the connection gasket 16, and to retract so as to ensure a gap in which the bullet B is pushed up in the rear end portion of the barrel. Thereafter, the inter-nozzle 28 advances so as to push the bullet B into the cartridge portion 14.

The air-blast nozzle 24 is provided at a position leaning to the center of the pipe members 25, 25, 25 of the three cylinders 21, 22, 23. This countermeasure is provided because the air-blast nozzle 24 cannot coincide with the center of a cylinder pipe having a diameter larger than the barrel, since the number of a plurality of the barrels 11, 12, 13 in the illustrated example is three. Thus, the position of the air-blast nozzle 24 is determined based on the relationship between the barrel and the position of the center of the cylinder pipe.

Figure 5:
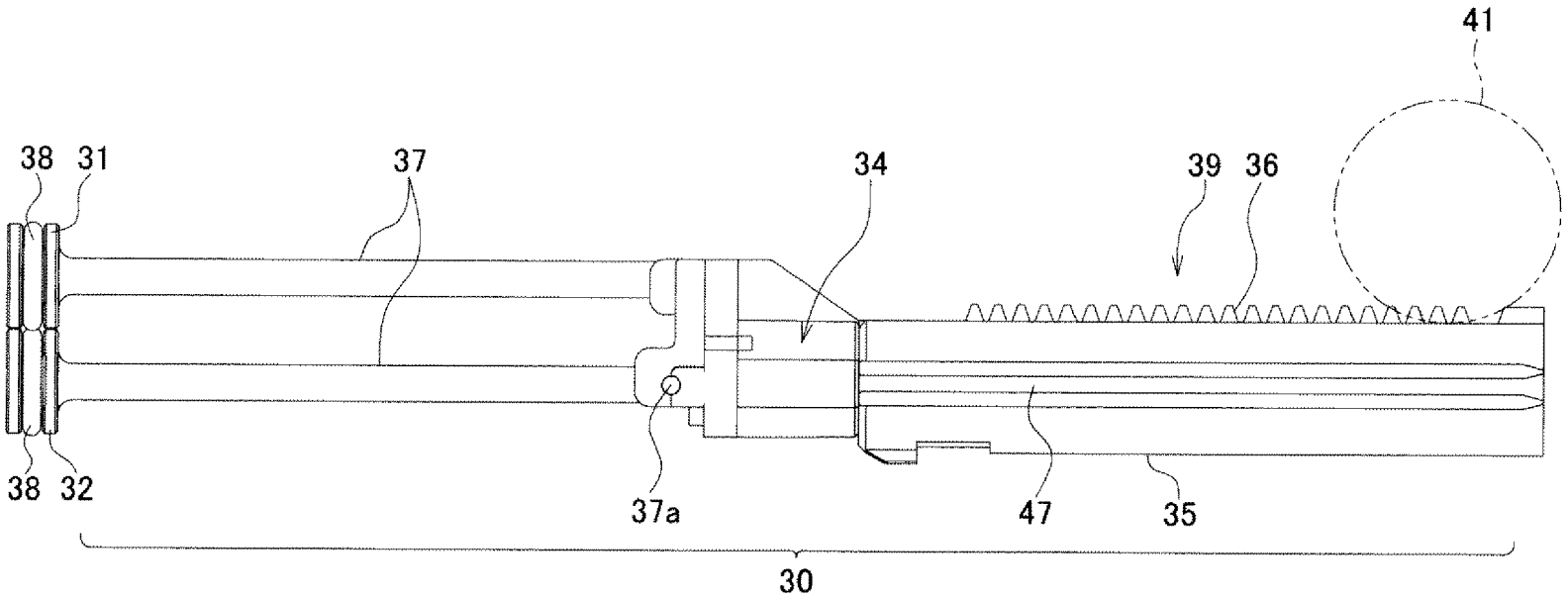
FIG. 5 is a side view illustrating the piston assembly according to the invention.

The piston assembly 30 has the three pistons 31, 32, 33 which respectively reciprocate inside the cylinders 21, 22, 23 and generate compressed air. In addition, the three pistons 31, 32, 33 are configured to be bound in one place by a joint portion 34 at the rear and to be integrally provided with one piston shaft 35 having a rack 36 along a reciprocating direction and the joint portion. (refer to FIG. 5).

The three pistons 31, 32, 33 are flexibly joined to the joint portion 34 such that seal performance between the pistons 31, 32, 33 and cylinder inner wall surfaces is maintained due to the joined state. That is, when the pistons and the cylinders configuring a piston cylinder mechanism have high precision in the positional relationship or the fitting state therebetween, it becomes easy to obtain high compressibility. Moreover, the axial centers therebetween also have to coincide with each other with high precision. However, when a certain degree of flexibility is allowed, it is possible to obtain high compressibility without requiring excessive precision.

In order to apply the flexibility, the present invention employs a configuration in which the pistons 31, 32, 33 are provided at the tip end of slender rods 37 so as to be movably pivoted by the joint portion 34 at the rear of the rods 37. In the configuration of the illustrated embodiment, the rods 37 are pivoted with respect to the reciprocating direction of the pistons by using a pivot 37*a* in the transverse direction such that the rods 37 become movable in the vertical direction. The air-tightness of the pistons 31, 32, 33 is maintained by using the illustrated O-rings as seal members 38.

In the configuration of the embodiment in which the piston cylinder mechanism is constituted by three sets, as described above, the three sets are combined in the piston assembly 30 so as to have a triangle shape when seen from the front, the piston shaft 35 is disposed in the joint portion 34 with a positional relationship of being shifted downward from a central portion of the three sets, and the rack 36 is positioned at the top of a part which is shifted downward. Therefore, the position of the rack 36 becomes close to the central portion of the three sets. Accordingly, it is possible to gain a disposition space 39 for the electric mechanism 40 of an output gear 41, and driving force of the output gear 41 is more efficiently transmitted from a position close to the center line.

Figure 6:
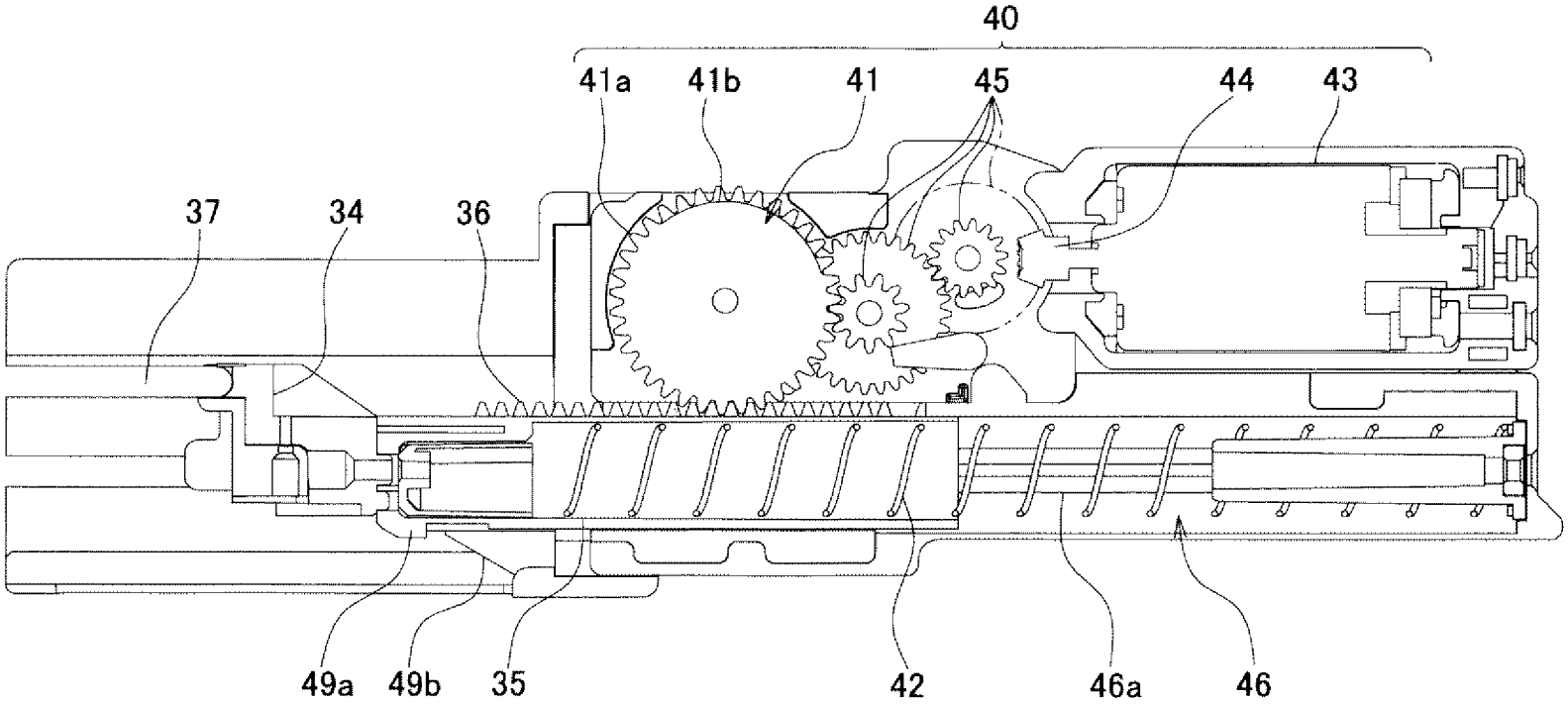
FIG. 6 is a view illustrating the electric mechanism according to the invention.

The electric mechanism 40 is configured to cause the piston assembly 30 to retract, to cause an elastic member 42 to accumulate pressure, and to drive the output gear 41 meshing with the rack 36 in order to compress air by releasing the accumulated pressure. As a description with reference to FIG. 6 in detail, the reference sign 43 indicates an electric motor, that is, a motor, the reference sign 44 indicates a pinion attached to a rotary shaft thereof, and the reference sign 45 indicates a reduction gear set constituted by several gears meshing with the pinion 44. The output gear 41 is constituted by a sector gear. The sector gear 41 has a toothed portion 41*a* which meshes with the rack 36 and causes the piston assembly 30 to retract, and a non-toothed portion 41*b* which does not mesh with the rack 36 and enables the piston assembly 30 to advance.

The piston shaft 35 has a hollow structure and is biased in the advancing direction by the elastic member 42 illustrated as a coil spring which is hollow inside. One end of the elastic member 42 constituted by the coil spring is in contact with the front end of the piston shaft which is hollow inside, and the other end is supported by the rear end of the cavity which is a movement portion 46 for the piston provided inside the electric mechanism 40. The reference sign 47 indicates a guide portion constituted by an irregular structure. The guide portion 47 is provided in a laterally longitudinal direction of the piston shaft 35 and engages with a projection 46*a* which is an engagement counterpart constituted by an irregular structure provided on the gun main body side, thereby functioning as a guide for moving straight forward (refer to FIG. 6).

In addition to the description above, the multi-bullet shooting electric gun G of the embodiment includes mechanisms required for operating as an electric gun, such as a power source battery (not illustrated), a circuit connecting the power source battery and the electric motor 43, and a switch for turning on and off the power source. The reference sign 18 indicates the switch, the reference sign 19 indicates an outer barrel housing the three barrels, the reference sign 48 indicates a selector unit for selecting a shooting mode, and the reference sign 49 indicates the aforementioned latch member. The latch member 49 is pivoted at the rear end of the nozzle base 29 by a pivot 29*a* as vertically movable engagement means. The latch member 49 is configured to be retractable by being engaged with an engagement counterpart portion 49*a* provided in the piston shaft 35 and to be able to be disengaged by coming into contact with a disengagement portion 49*b* provided on the gun main body side. The reference sign 49*c* is a spring, which is means biasing the latch member 49 in a direction for engaging with the engagement counterpart portion 49*a* (refer to FIG. 2). The spring 29*b* is configured to act on the nozzle base 29 as forward biasing means so as to push out the supplied bullet B to the cartridge portion 14.

In the simulation gun G having such a configuration, the cut-off device of the present invention cuts off the operation of the electric mechanism 40 actuated through a trigger operation. As described above, it is understood that the simulation gun G is a long barreled-type, and the pistons 31, 32, 33 are retractable by the length of the stroke. Therefore, the piston cylinder mechanism has the maximum length longer than twice the stroke, and the electric mechanism is disposed in the rear end portion of the piston cylinder mechanism. The stroke of the piston cylinder mechanism is formed so as to be longer than those of general piston cylinder mechanisms, and thus, it is possible to generate compressed air having the required pressure without difficulty.

Figure 7A:
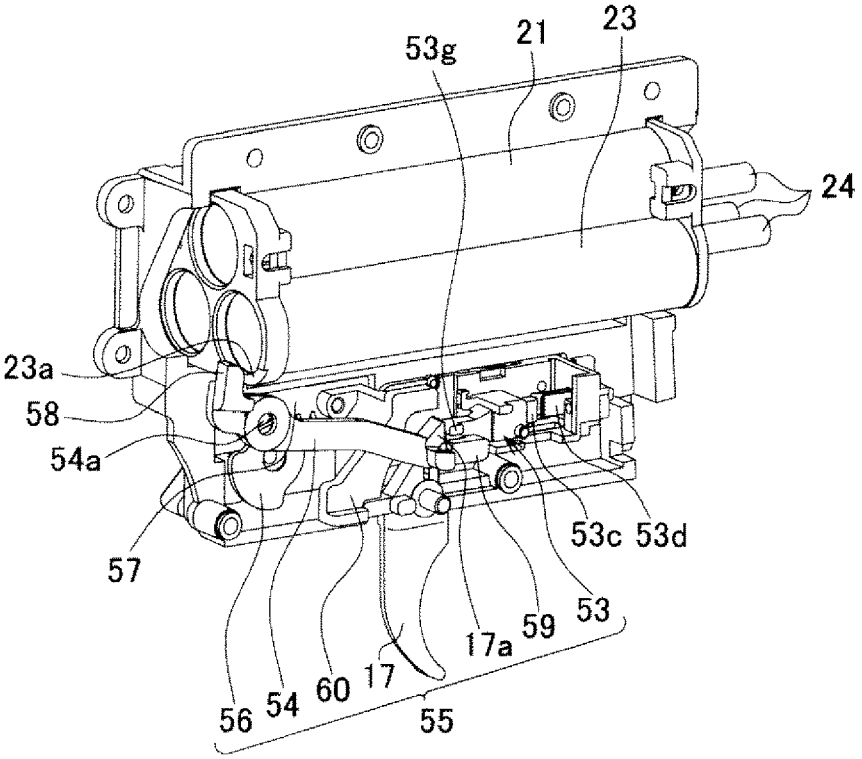
FIG. 7A is a perspective view in its entirety.
Figure 7B:
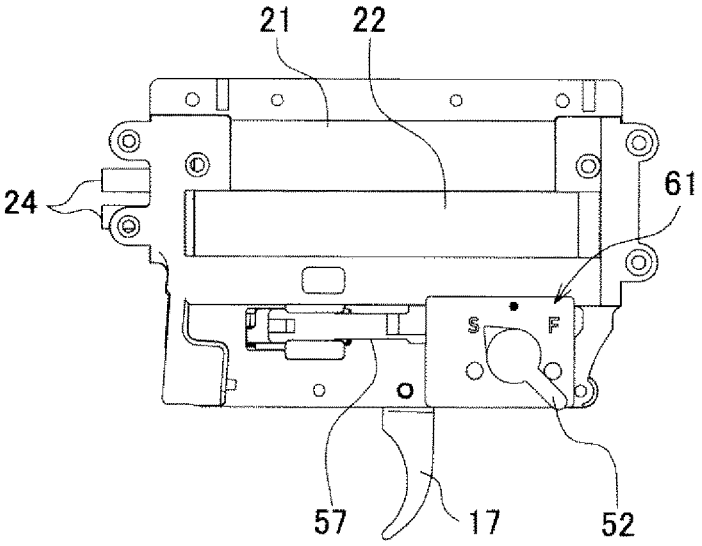
FIG. 7B is a side view illustrating a surface on the opposite side of FIG. 7A, on which a selector operating unit is provided.

The cut-off device of the present invention selects any one of a single shooting mode in which one bullet shooting is performed through one reciprocating operation in the piston cylinder mechanism, and a successive shooting mode in which a plurality of the bullet shootings are performed through a plurality of the reciprocating operations in the piston cylinder mechanism. Therefore, there is provide a switching mechanism 55 which controls a drive circuit of the electric motor 43. The switching mechanism 55 has a selector operating unit 52 which is provided in order to select between at lease the single shooting mode and the successive shooting mode, a switching member 53 which configures the switch 18 closing the drive circuit in response to an operation of a trigger, and a cut-off member 54 which engages with a movable portion being driven in one direction and turns on the switching member 53 when the single shooting mode is selected (refer to FIG. 7A). The selector operating unit 52 is on the opposite side of the cut-off member 54 (refer to FIG. 7B).

Figure 8A:
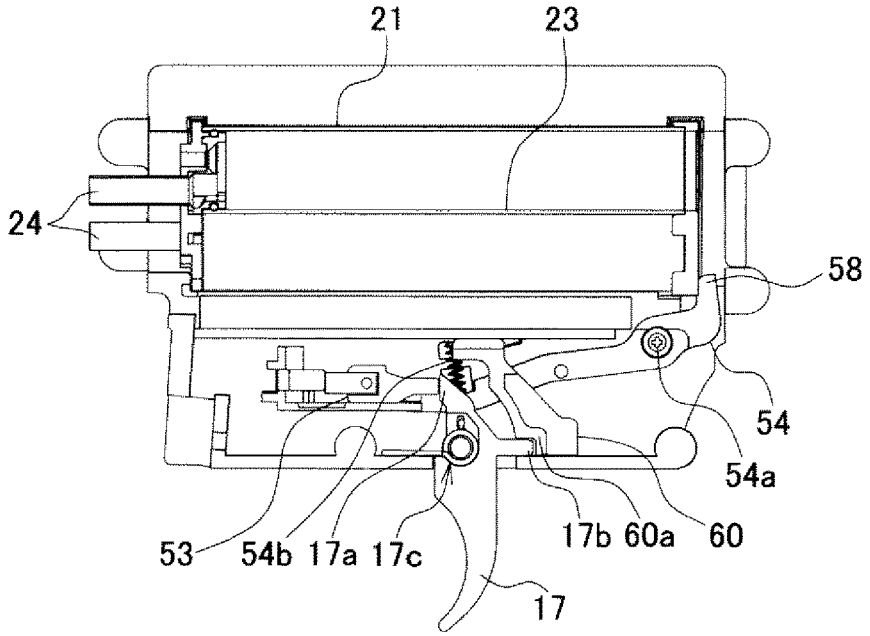
FIG. 8A is a left-side view.
Figure 8B:
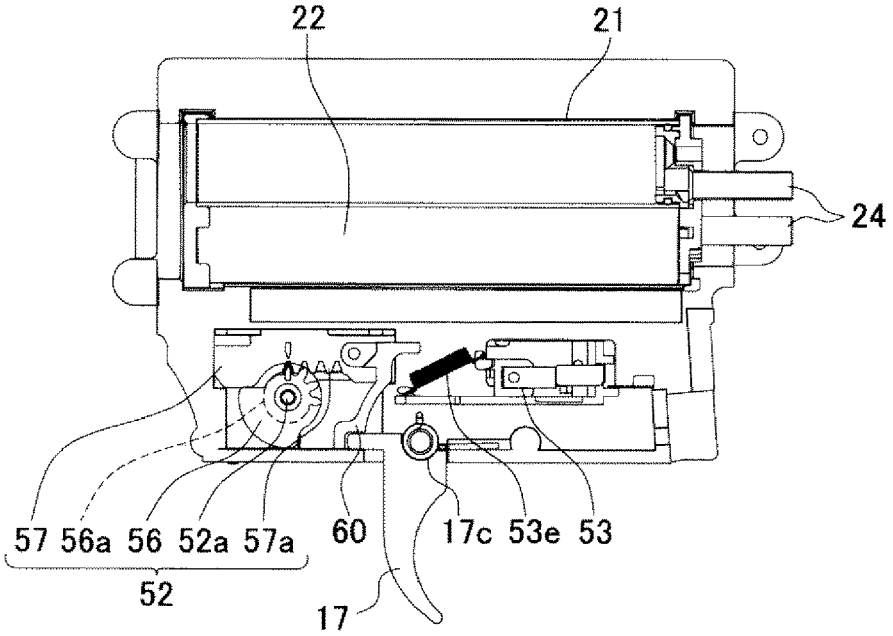
FIG. 8B is a right-side view.

In the example of the embodiment, the selector operating unit 52 is configured to be able to select among three modes such as a safety mode: S, in which a trigger 17 is locked so as not to be able to be operated S, the single shooting mode: •, in which one bullet shooting is performed through one trigger operation, and the successive shooting mode: F, in which the bullet shooting is repeated time and again while the trigger 17 is operated (refer to FIG. 7B). The selector operating unit 52 has a selector click 56 which is assembled in an attachment member at a lower portion of the cylinder assembly so as to be rotatable by a pivot 52*a*, is coaxial with the pivot 52*a*, and is positioned on the opposite side of the pivot 52*a*. The selector operating unit 52 also has a selector member 57 which meshes with a gear 56*a* coaxial with the selector click 56 and is movable back and forth in accordance with rotation thereof (refer to FIG. 8B). The reference sign 57*a* indicates rack teeth for the meshing, and the gear 56*a* is on the rear surface of the selector click 56.

Figure 9A:
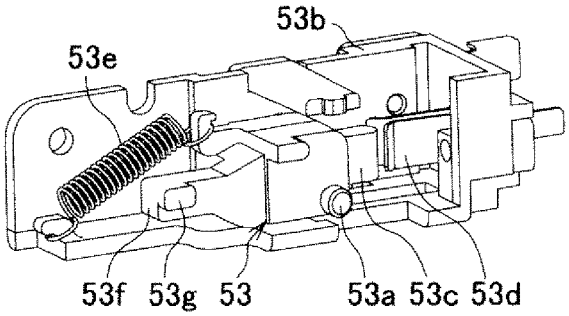
FIG. 9A is a perspective view.
Figure 9B:
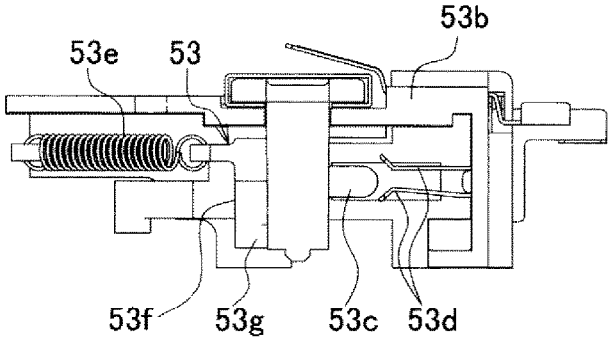
FIG. 9B is a plan view.
Figure 9C:
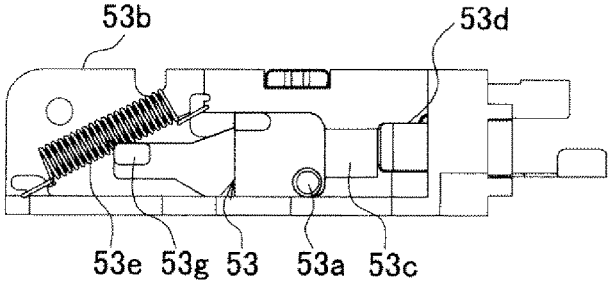
FIG. 9C is a right-side view.

The switching member 53 configures the switch 18, and the main body is rotatably and pivotally supported in a switch attachment member 53*b* by a pivot 53*a*. A spring 53*e* acting in a switch-off direction is attached to the main body of the switching member 53 (refer to FIG. 9). The switching member 53 is turned on when a core 53*c* at the tip end of the main body and a switch terminal 53*d* are in contact with each other and is turned off when being in non-contact with each other. In addition, in the rear portion of the switching member 53, there is provided a part 53*f* being pressurized by a pressurization portion 17*a* which is provided above the trigger 17. Therefore, the trigger 17 is provided with a spring 17*c* acting in a direction against a pulling operation.

The cut-off member 54 is rotatably attached on the gun main body side by a pivot 54*a*. An end portion 58 on one side thereof extends to the rear end portion side of the piston cylinder mechanism, and an end portion 59 on the other side extends to the switching member 53 side. The end portion 58 on one side is formed so as to have an approximately L-shape and to be able to engage with a head portion of the piston 33 among one of the pistons 31, 32, 33 which are the movable portions. The end portion 58 on one side is formed in the rear end portion of the cylinder 23 to which a notch 23*a* exposing the rear end of the head portion corresponds for engagement. The end portion 59 of the cut-off member 54 on the other side is provided so as to be able to engage with one portion 53*g* formed in the switching member 53 (refer to FIG. 7A). In addition, a spring 54*b* causes the cut-off member 54 to be biased in a direction in which the end portion 58 on one side comes into contact with the notch 23*a* of the cylinder (refer to FIG. 8A).

A trigger interlocking portion 60 is combined with the trigger 17. The trigger interlocking portion 60 is pivotally supported so as to be integrally movable with the selector member 57. The trigger interlocking portion 60 has a projection fixing portion 60*a* which fixes the trigger 17 by being engaged with a projection 17*b* provided in the trigger 17. The selector interlocking portion 60 enables the trigger 17 to be operated through a mode selecting operation of the selector operating unit 52 by being integrally formed with the selector member 57. The selector click 56 is fixed while generating click feeling at positions of the three modes. However, a mechanism applying the click feeling can be executed through a known method in the related art. The three modes are expressed in a display 61, such as a safety mode: S, a semi-automatic mode: •, and a full-automatic mode: F (refer to FIG. 7B).

Figure 10A:
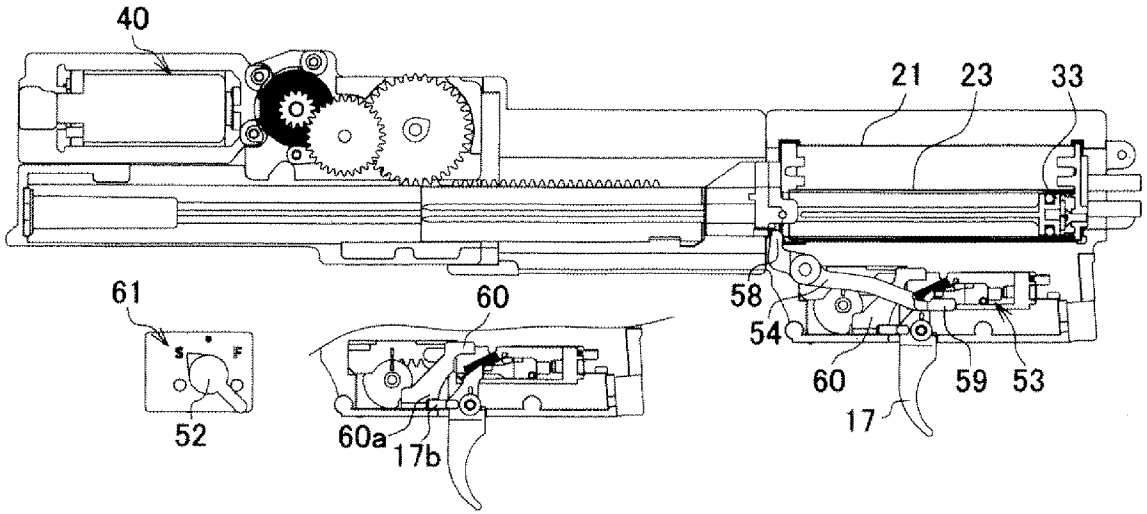
FIG. 10A is a sectional view illustrating a ready-to-shoot state in which the selector operating unit is in a safety mode.
Figure 10B:
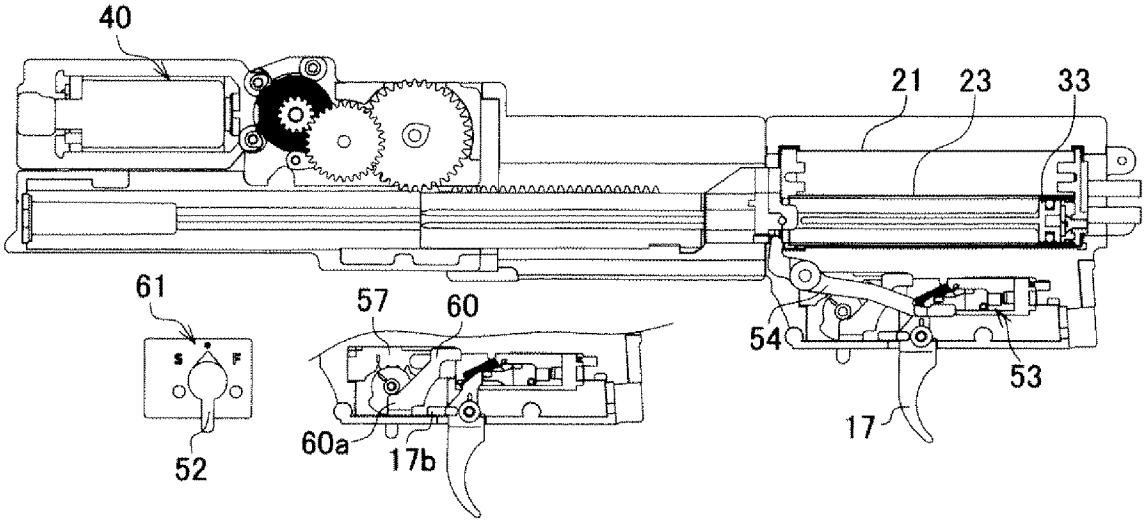
FIG. 10B is a sectional view illustrating a semi-automatic mode state according to the invention.

An operation of the cut-off device of the present invention having such a configuration will be described with reference to FIG. 10 and thereafter. The simulation gun which is an electric gun is considered to be in an operable state. FIG. 10A illustrates a state when being in the safety mode as is clear from the position of the selector operating unit 52. In the piston cylinder mechanism, the pistons 31, 32, 33 are at advanced position, and the trigger interlocking portion 60 interlocks the trigger 17. Therefore, the trigger 17 cannot be operated. Then, the switching member 53 configuring the switch 18 is turned off, and the end portion 58 of the cut-off member 54 on one side is in a state of protruding inward from the notch 23*a* of the cylinder 23. In this state, the selector operating unit 52 is switched to the semi-automatic mode: •, and the selector member 57 is moved rearward. Accordingly, the interlocked trigger interlocking portion 60 is released, and thus, the trigger 17 is in a state of being able to be pulled (FIG. 10B).

Figure 11A:
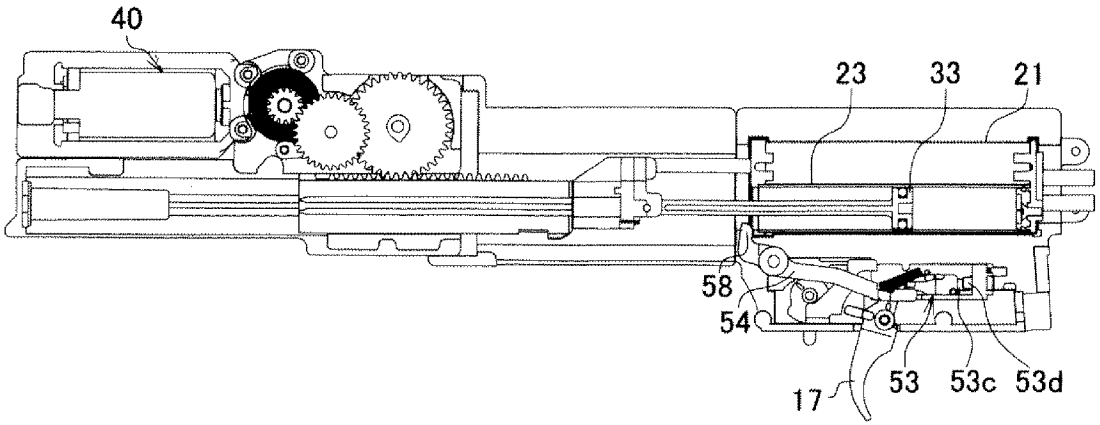
FIG. 11A is a sectional view illustrating a state where a trigger is pulled, the switch is turned on, and pistons start to retract.
Figure 11B:
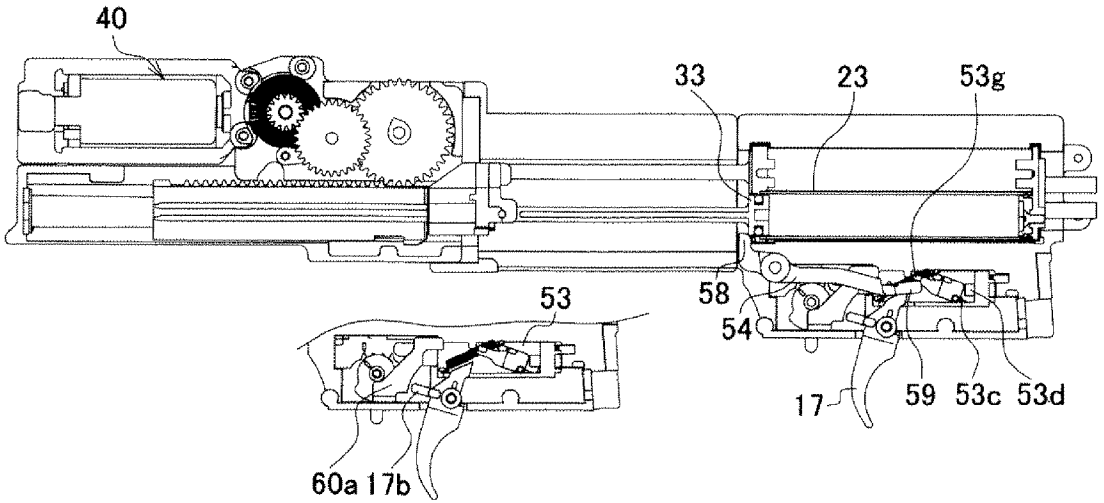
FIG. 11B is a sectional view illustrating a state where the pistons reach the vicinity of a retraction limit and the switch is hopped up and is turned off by a cut-off member.
Figure 12A:
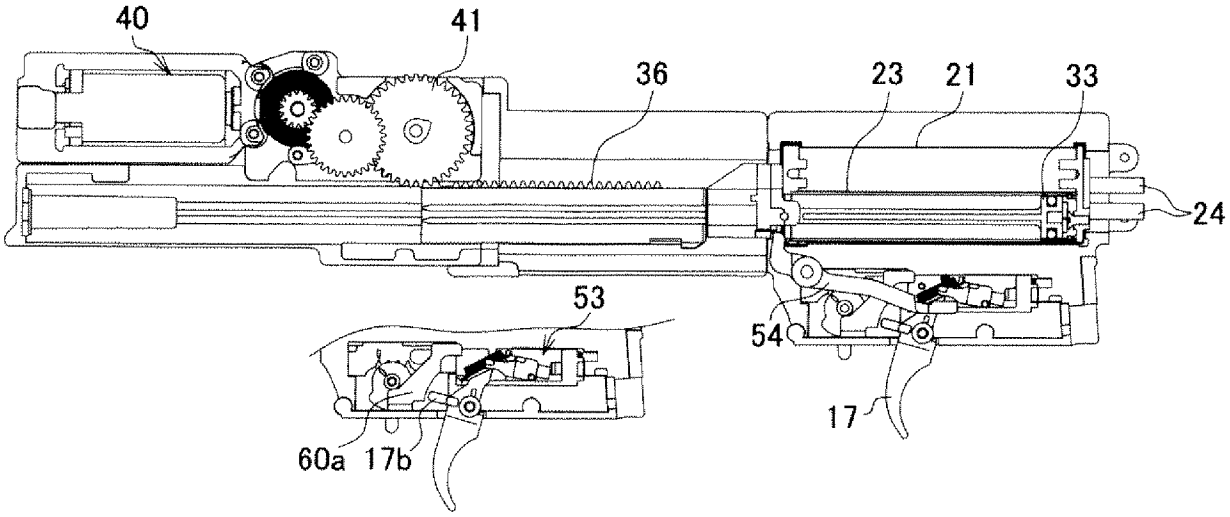
FIG. 12A is a sectional view illustrating a state where the pistons advance and compressed air is generated.

When the trigger 17 is pulled, the pressurization portion 17*a* above thereof pressurizes the part 53*f* of the switching member 53. Therefore, the pressed core 53*c* and the switch terminal 53*d* come into contact with each other, and the switching member 53 is turned on (FIG. 11A). Through an operation of turning on the switching member 53, the drive circuit is closed, the electric mechanism 40 is actuated, and the pistons 31, 32, 33 start to retract. When the pistons 31, 32, 33 reach the vicinity of a retraction limit, abut the end portion 58 of the cut-off member 54 on one side, and push down the end portion 58 of the cut-off member 54 on one side, the cut-off member 54 rotates in the counterclockwise direction of the view (FIG. 11B). Due to the rotation, the one portion 53*g* of the switching member 53 with which the end portion 59 of the cut-off member 54 on the other side engages is hopped up, the core 53*c* and the switch terminal 53*d* are separated from each other, and the switch 53 is turned off (FIG. 12A). That is, the pistons 31, 32, 33 are reliably driven to the retraction limit. After the pistons 31, 32, 33 start to retract, the latch member 49 and the engagement counterpart portion 49*a* engage with each other, and are disengaged from each other by the disengagement portion 49*b*. Then, a next bullet is loaded while the nozzle base 29 retracts and advances.

Figure 12B:
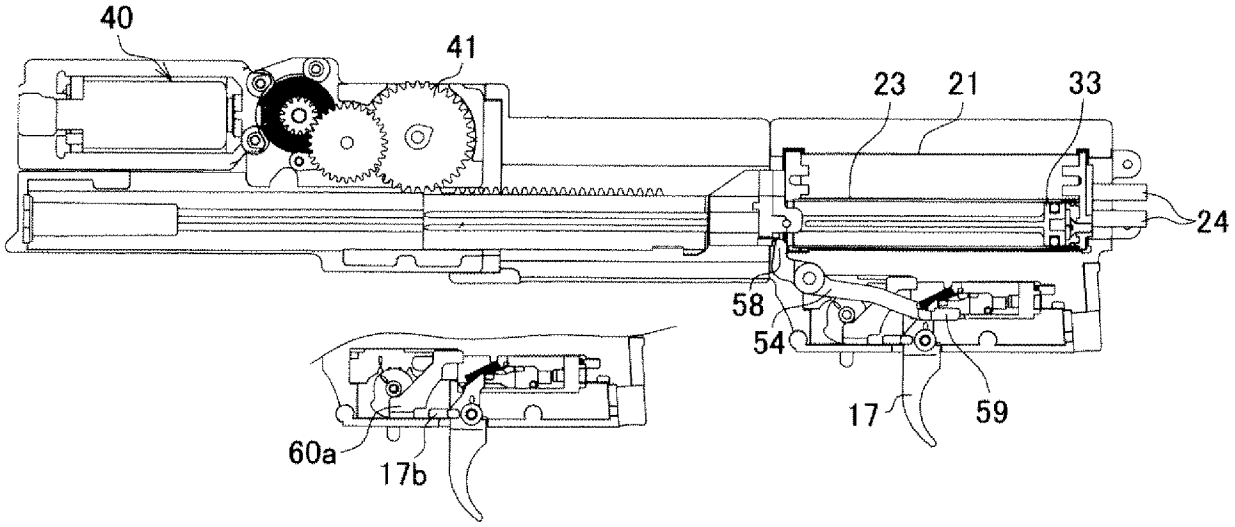
FIG. 12B is a sectional view illustrating a state where the switch returns to an original state.

At the same time as the switching member 53 is turned off, the sector gear 41 of the electric mechanism 40 moves from the toothed portion 41*a* to the non-toothed portion 41*b* and is unmeshed from the rack 36. As a result, pressure accumulated in the elastic member 42 is released, and the pistons 31, 32, 33 instantaneously move to an advancing limit. Then, air inside the cylinder is compressed and is blasted as compressed air from the blast nozzle 24 (FIG. 12A). When the pistons 31, 32, 33 advance, the end portion 58 of the cut-off member 54 on one side is in a state of protruding to the rear end portion of the cylinder 23, and the end portion 59 on the other side is lowered so that the switching member 53 cannot be hopped up, thereby ending the cutting-off (FIG. 12B). In this manner, the single shooting mode in which one bullet shooting is performed through one reciprocating operation in the piston cylinder mechanism is performed. Consequently, one shot each from three barrels 11, 12, 13, that is, three bullets B in total are shot.

Figure 13:
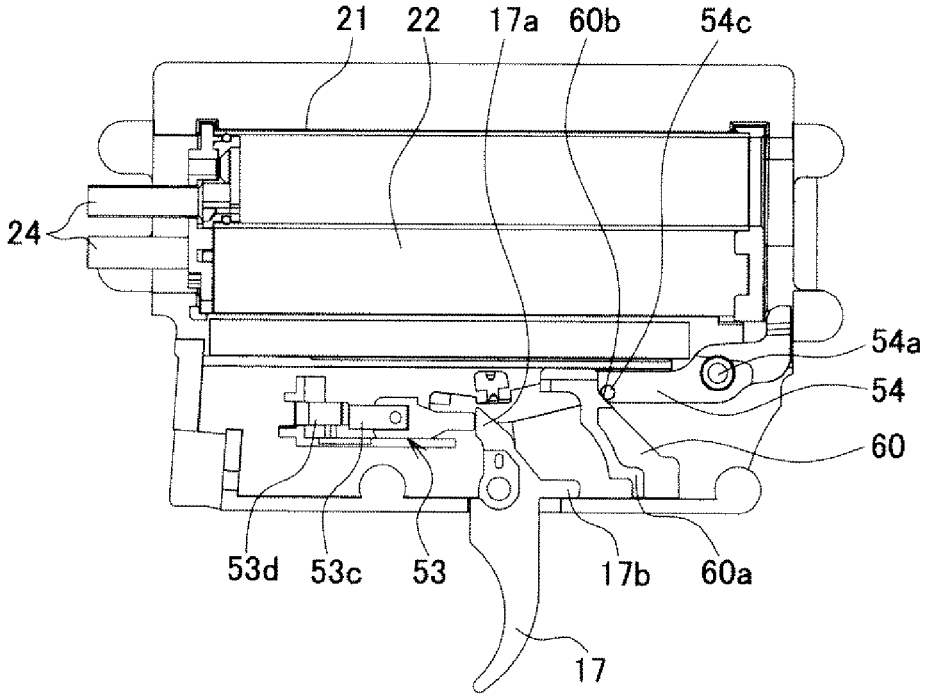
FIG. 13 is a sectional view illustrating a state where a cut-off mechanism is invalidated in a full-automatic mode.

When the selector operating unit 52 is switched to the full-automatic mode: F, the bullet B can be successively shot. In the full-automatic mode, the trigger interlocking portion 60 further retracts together with the selector member 57 in accordance with the switching of the selector operating unit 52. In response to the retraction of the trigger interlocking portion 60, a cam portion 60*b* thereof engages with an engagement portion 54*c* provided in the cut-off member 54 (refer to FIG. 13). When the cam portion 60 engages with the engagement portion 54*c*, the cut-off member 54 rotates and moves upward along the shape of the cam surface. When the cut-off member 54 rotates and moves upward, the cut-off member 54 is separated from the switch 53, and a cut-off mechanism is invalidated. As a result, the switching member 53 retains an ON state while the trigger 17 is continuously pulled, and the piston cylinder mechanism repeats the reciprocating operation. Consequently, the bullet B can be successively shot three shots at a time.

The invention claimed is:

1. A simulation gun comprising a barrel, a compressed air generating unit, a switching mechanism and a trigger;

wherein the compressed air generating unit comprises an electric mechanism and a piston cylinder mechanism, and the electric mechanism through a drive circuit drives a movable portion of the piston cylinder mechanism to generate compressed air for shooting a bullet;

wherein, a bullet shooting direction is defined as a front direction and an opposite side of the bullet shooting direction is defined as a rear direction; the barrel, the piston cylinder mechanism, and the electric mechanism are sequentially disposed from the front direction to the rear direction;

wherein the switching mechanism comprises a selector, a switching member and a cut-off member, the selector is adapted to be set between at least a single shooting mode and a successive shooting mode, and the switching member is adapted to, in response to an operation of the trigger, close the drive circuit to make the electric mechanism drive the movable portion of the piston cylinder mechanism, wherein the cut-off member comprises a rear end portion extending toward a rear end portion of the piston cylinder mechanism and a front end portion extending toward the switching member, the cut-off member is adapted to rotate about a pivot between the rear end portion of the cut-off member and the front end portion of the cut-off member, the rear end portion of the cut-off member can engage with the rear end portion of the piston cylinder mechanism, and the front end portion of the cut-off member can engage with the switching member, wherein, when the selector is set at the single shooting mode, the rear end portion of the cut-off member engages with the rear end portion of the piston cylinder mechanism, the cut-off member rotates and the front end portion of the cut-off member engages with the switching member to break the drive circuit after the movable portion of the piston cylinder mechanism begins to retract, and wherein, depending on the length of the movable portion of the piston cylinder mechanism, the length of time from the start of retraction of the movable portion of the piston cylinder mechanism until the execution of the cut-off is adjusted, wherein the selector is located behind the trigger, a selector operating unit of the selector comprises a pivot connecting to an attachment member on the piston cylinder mechanism, a selector click provided coaxially with the pivot, a gear provided coaxially with the selector click, and a selector member having rack teeth mesh and being movable back and forth;

wherein a trigger interlocking portion is pivotally supported so as to be integrally movable with the selector member such that operation of the trigger is locked or unlocked by moving the selector member forward or backward, respectively, and wherein the trigger is locked when the trigger interlocking portion engages the trigger, and the trigger is unlocked when trigger interlocking portion disengages the trigger.

2. A simulation gun comprising a barrel, a compressed air generating unit, a switching mechanism and a trigger;

wherein the compressed air generating unit comprises an electric mechanism and a piston cylinder mechanism, and the electric mechanism through a drive circuit drives a movable portion of the piston cylinder mechanism to generate compressed air for shooting a bullet;

wherein, a bullet shooting direction is defined as a front direction and an opposite side of the bullet shooting direction is defined as a rear direction; the barrel, the piston cylinder mechanism, and the electric mechanism are sequentially disposed from the front direction to the rear direction;

wherein the switching mechanism comprises a selector, a switching member and a cut-off member, the selector is adapted to be set between at least a single shooting mode and a successive shooting mode, and the switching member is adapted to, in response to an operation of the trigger, close the drive circuit to make the electric mechanism drive the movable portion of the piston cylinder mechanism, wherein the cut-off member comprises a rear end portion extending toward a rear end portion of the piston cylinder mechanism and a front end portion extending toward the switching member, the cut-off member is adapted to rotate about a pivot between the rear end portion of the cut-off member and the front end portion of the cut-off member, the rear end portion of the cut-off member can engage with the rear end portion of the piston cylinder mechanism, and the front end portion of the cut-off member can engage with the switching member, wherein, when the selector is set at the single shooting mode, the rear end portion of the cut-off member engages with the rear end portion of the piston cylinder mechanism, the cut-off member rotates and the front end portion of the cut-off member engages with the switching member to break the drive circuit after the movable portion of the piston cylinder mechanism begins to retract, and wherein, depending on the length of the movable portion of the piston cylinder mechanism, the length of time from the start of retraction of the movable portion of the piston cylinder mechanism until the execution of the cut-off is adjusted, wherein a trigger interlocking portion is behind the trigger, wherein the cut-off member has an engagement portion that can engage with the trigger interlocking portion, and wherein, when the selector is set at the successive shooting mode, the engagement portion engages with the trigger interlocking portion, the cut-off member rotates and the front end portion separates from the switching member to close the drive circuit.

3. The simulation gun according to claim 1, further comprising the trigger interlocking portion behind the trigger, wherein the cut-off member has an engagement portion that can engage with the trigger interlocking portion, and wherein, when the selector is set at the successive shooting mode, the engagement portion engages with the trigger interlocking portion, the cut-off member rotates and the front end portion separates from the switching member to close the drive circuit.

* * * * *